US010167597B2

(12) United States Patent
Rapp et al.

(10) Patent No.: US 10,167,597 B2
(45) Date of Patent: Jan. 1, 2019

(54) SNOW TILLER FOR PREPARING SKI SLOPES

(71) Applicant: PRINOTH S.p.A., Vipiteno (IT)

(72) Inventors: Sebastian Rapp, Matrei (AT); Thomas Kirchmair, Matrei (AT)

(73) Assignee: PRINOTH S.P.A, Vipiteno (IT)

( * ) Notice: Subject to any disclaimer, the term of this patent is extended or adjusted under 35 U.S.C. 154(b) by 0 days.

(21) Appl. No.: 15/037,608

(22) PCT Filed: Nov. 20, 2014

(86) PCT No.: PCT/IB2014/066206
§ 371 (c)(1),
(2) Date: May 18, 2016

(87) PCT Pub. No.: WO2015/075670
PCT Pub. Date: May 28, 2015

(65) Prior Publication Data

US 2016/0289906 A1 Oct. 6, 2016

(30) Foreign Application Priority Data

Nov. 20, 2013 (IT) ..... MI2013A001925

(51) Int. Cl.
*E01H 4/02* (2006.01)

(52) U.S. Cl.
CPC ..... *E01H 4/02* (2013.01)

(58) Field of Classification Search
CPC ..... E01H 4/00; E01H 4/02; E01H 5/09
See application file for complete search history.

(56) References Cited

U.S. PATENT DOCUMENTS 554,260 A * 2/1896 Glover ..... E01H 4/02 37/224
682,731 A * 9/1901 Munson ..... E01H 5/09 37/208
1,111,628 A * 9/1914 Wettervik ..... E01H 4/02 37/224
1,651,247 A * 11/1927 Bodenstein ..... E01H 4/00 172/197
1,654,685 A * 1/1928 Gettelman ..... E01H 5/09 37/242

(Continued)

FOREIGN PATENT DOCUMENTS

EP 0 287 897 10/1988

OTHER PUBLICATIONS

Notification of the Recording of a Change Form PCT/IB/306 for International Application No. PCT/IB2014/066206.

(Continued)

*Primary Examiner* — Jessica H Lutz
(74) *Attorney, Agent, or Firm* — Neal, Gerber & Eisenberg LLP

(57) ABSTRACT

A ski slope snow tiller configured to travel in a travelling direction along the ski slope; the snow tiller having two supporting structures hinged to each other about a hinge axis; two shafts housed respectively in the supporting structures and configured to rotate about respective rotation axes crosswise to the travelling direction; tools fitted to the shafts; and at least one further tool connected at least to a shaft and located between the two supporting structures.

17 Claims, 3 Drawing Sheets

(56) References Cited

U.S. PATENT DOCUMENTS 2,381,017 A * 8/1945 Wandscheer ..... E01H 5/09 37/248
2,723,470 A * 11/1955 Harnack ..... E01H 5/09 37/238
2,911,734 A * 11/1959 Sublett ..... E01B 27/04 37/104
3,796,505 A * 3/1974 Buhler ..... E01H 4/02 180/20
4,019,268 A * 4/1977 Waterman ..... E01H 4/02 172/180
4,057,916 A * 11/1977 Roemer ..... E01H 4/02 172/393
4,348,825 A * 9/1982 Bachler ..... E01H 4/02 172/199
4,359,831 A * 11/1982 Beeley ..... E01H 4/02 172/112
4,446,679 A * 5/1984 Thomas ..... A01D 42/00 37/243
4,520,582 A * 6/1985 Niemela ..... E01H 4/02 172/154
4,718,183 A * 1/1988 Haug ..... E01H 4/02 172/684.5
5,067,264 A * 11/1991 Beeley ..... E01H 4/02 172/112
5,084,992 A * 2/1992 Sinykin ..... E01H 4/02 172/250
5,581,914 A * 12/1996 Sinykin ..... E01H 4/02 172/112
5,632,106 A * 5/1997 Sinykin ..... E01H 4/02 172/250
5,659,984 A * 8/1997 Haug ..... A61K 47/48284 172/123
5,809,671 A * 9/1998 Sinykin ..... E01H 4/02 172/250
6,351,899 B1 * 3/2002 Slutzky ..... E01H 4/02 180/9.52
6,367,176 B1 * 4/2002 Zaugg ..... E01H 4/02 37/240
6,418,645 B1 * 7/2002 Hammerle ..... E01H 4/02 172/72
7,997,826 B2 * 8/2011 Dufty ..... A01B 29/02 404/125
2003/0051376 A1 * 3/2003 Lassonde ..... E01H 4/02 37/348

OTHER PUBLICATIONS

WIPO Letter for International Application No. PCT/IB2014/066206 dated May 13, 2016.
Notification Concerning Submission, Obtention or Transmittal of Priority Document for International Application No. PCT/IB2014/066206 dated Mar. 9, 2015.
International Search Report and Written Opinion for International Application No. PCT/IB2014/066206 dated Mar. 23, 2015.
PCT Demand for International Preliminary Examination and Reply to International Search Report and the associated Written Opinion for International Application No. PCT/IB2014/066206 dated Sep. 18, 2015.
Notification of Receipt of Demand by Competent International Preliminary Examining Authority (Form PCT/IPEA/402) for International Application No. PCT/IB2014/066206 dated Sep. 25, 2015.
Second Written Opinion of the International Preliminary Examining Authority for International Application No. PCT/IB2014/066206 dated Nov. 30, 2015.
Reply to the Second Written Opinion of the International Searching Authority for International Application No. PCT/IB2014/066206 dated Feb. 2, 2016.
Notification of Transmittal of the International Preliminary Report on Patentability (Form PCT/IPEA/416) for International Application No. PCT/IB2014/066206 dated Mar. 14, 2016.

* cited by examiner

SNOW TILLER FOR PREPARING SKI SLOPES

PRIORITY CLAIM

This application is a national stage application of PCT/IB2014/066206, filed on Nov. 20, 2014, which claims the benefit of and priority to Italian Patent Application No. MI2013A 001925, filed on Nov. 20, 2013, the entire contents of which are each incorporated by reference herein.

BACKGROUND

Normally, a snow tiller for preparing ski slopes is able to be drawn in a travelling direction along the ski slope, and comprises a supporting structure; and a shaft which is able to be rotated with respect to the supporting structure about an axis crosswise to the travelling direction, and is fitted with tools, each extending crosswise to the shaft axis.

Certain large snow tillers have the drawback of failing to adapt to the contour of uneven snow surfaces. To eliminate this drawback, large articulated tillers have been devised, which are divided into sectors, each with a supporting structure and a respective shaft. The supporting structures are connected by hinges with axes substantially parallel to the travelling direction, and the shafts are powered by respective motors connected to respective ends of the shafts.

In actual use, articulated tillers of the type described above are unable to work the part of the snow surface in the gap between the two supporting structures, thus resulting in relatively poor grooming of the ski slope.

European Patent Document EP 0 287 897 discloses a flexible rotary snow tiller.

SUMMARY

The present disclosure relates to a snow tiller configured to prepare ski slopes.

It is an advantage of the present disclosure to provide a snow tiller configured to prepare ski slopes which eliminates certain of the above drawbacks of certain of the known art.

According to the present disclosure, there is provided a snow tiller configured to prepare ski slopes and able to be drawn in a travelling direction along the ski slope; the snow tiller comprising at least two supporting structures hinged to each other about at least one hinge axis; at least two shafts housed respectively in the supporting structures and able to be rotated about respective rotation axes crosswise to the travelling direction; tools fitted to the shafts; and at least one further tool connected at least to a shaft and located between the two supporting structures; wherein each shaft is supported by the respective supporting structure; the two supporting structures being coupled to each other by at least one articulated coupling enabling relative movement between the two supporting structures; wherein each shaft comprises a flange extending partly between the two supporting structures; and the further tool is fixed to one of the two flanges; the snow tiller comprising a blade which defines the further tool and is fixed directly to the one of the two flanges. In certain embodiments, the blade is fixed along the face of the one of the two flanges.

By virtue of the present disclosure, the tiller adapts readily to the terrain, while at the same time ensuring more even grooming of the ski slope as compared with the known art, by virtue of the further tool.

The articulated coupling enables the supporting structures to move and so adapt to the contour of the snow surface.

In another embodiment, each supporting structure comprises respective bars; and a casing fixed to and supported by the respective bars.

In another embodiment, the tiller comprises a supporting bar coupled to the supporting structures by further articulated couplings, so as to support the supporting structures and permit relative movements between the supporting structures and the supporting bar.

The articulated couplings result in a structure that adapts readily to the contour of the snow surface and therefore of the underlying terrain, thus enabling better grooming of the snow surface.

In another embodiment, the further articulated couplings are configured to permit relative movements between the supporting structures in a direction perpendicular to the travelling direction.

In another embodiment, the tiller comprises a joint connected to the shafts and configured to permit relative angular movements between the shafts.

In another embodiment, the further tool is mounted on the joint, such as at one end of the joint.

In another embodiment, each shaft comprises a flange connected to the end of the joint; and the further tool is located on the joint and fixed to one of the two flanges.

In another embodiment, the tiller comprises a blade defining further tools positioned 180° apart.

In another embodiment, the blade has a hollow portion to permit assembly of the joint, and is fixed to one of the two flanges.

In another embodiment, the tiller comprises a further blade defining another two further tools; the blade and the further blade being positioned at an angle of 90° to each other.

The two blades at 90° to each other thus provide a tool every 90°, to ensure thorough grooming of the snow surface.

Additional features and advantages are described in, and will be apparent from the following Detailed Description and the figures.

BRIEF DESCRIPTION OF THE DRAWINGS

A number of non-limiting embodiments of the present disclosure will be described by way of example with reference to the attached drawings, in which.

DETAILED DESCRIPTION

Figure 1:
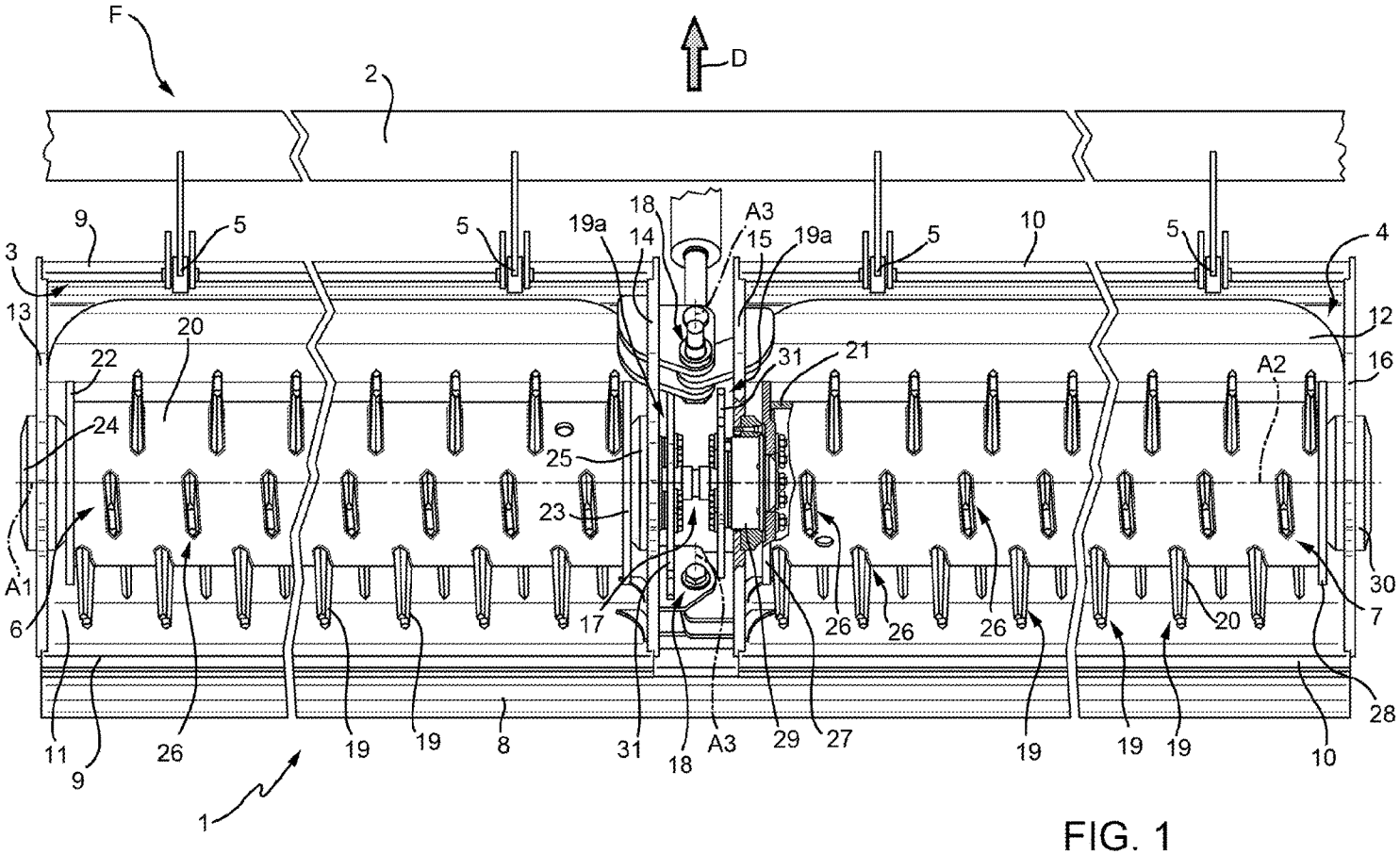
FIG. 1 shows an underside view, with parts removed for clarity, of a snow tiller configured to prepare ski slopes in accordance with the present disclosure.
Figure 2:
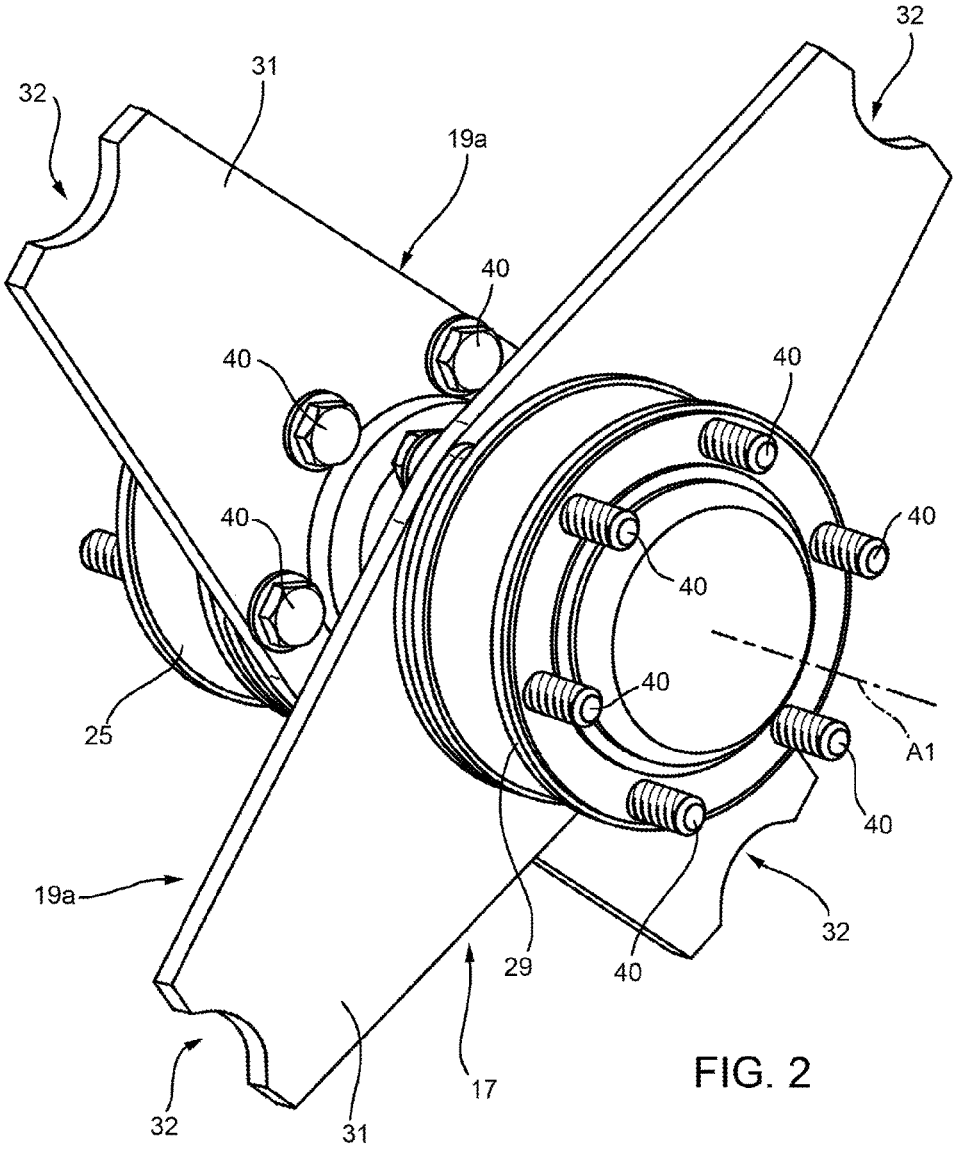
FIG. 2 shows a larger-scale view in perspective, with parts removed for clarity, of a detail of the FIG. 1 snow tiller.
Figure 3:
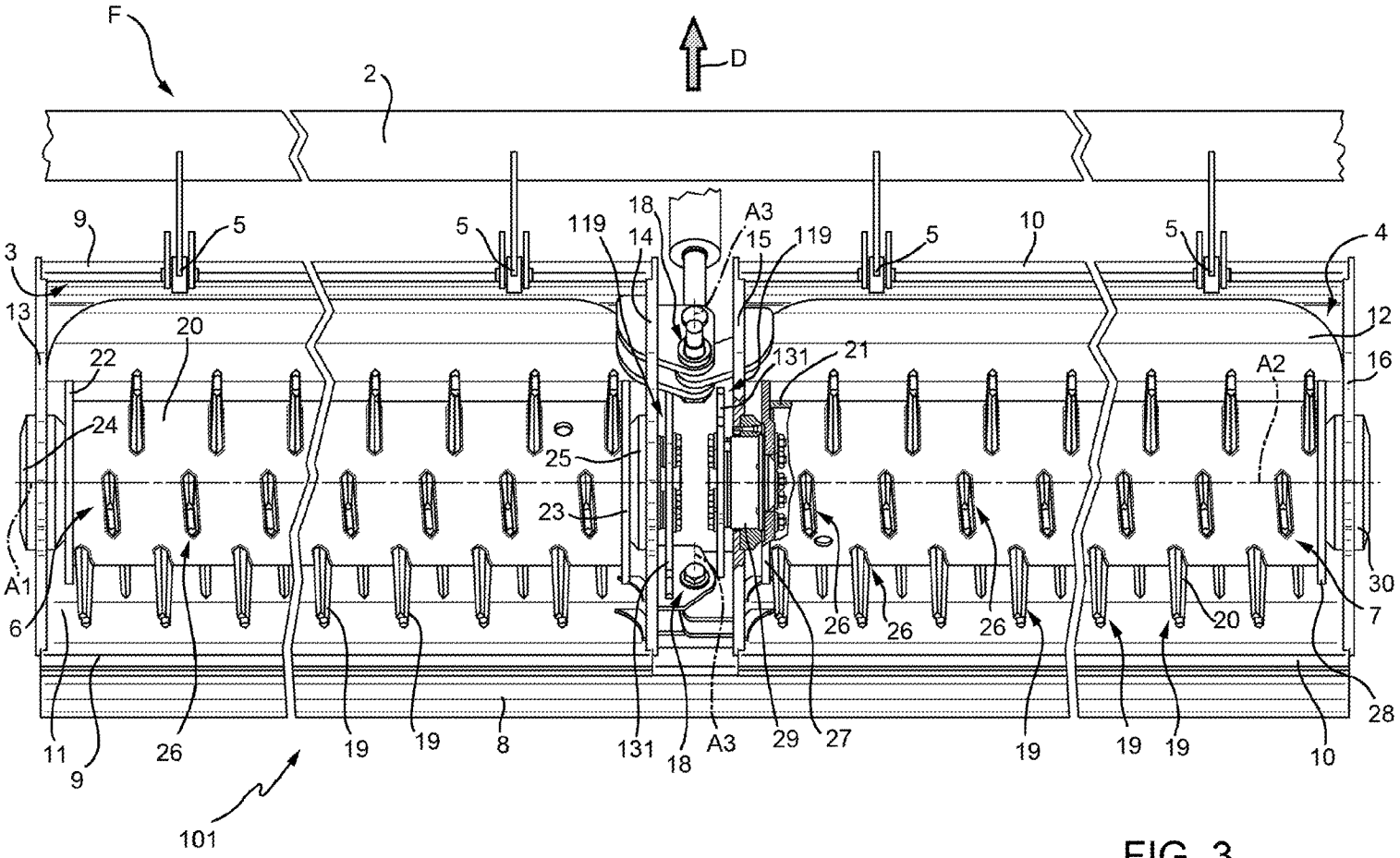
FIG. 3 shows an underside view, with parts removed for clarity, of an alternative embodiment of the FIG. 1 snow tiller.

Referring now to the example embodiments of the present disclosure illustrated in FIGS. 1 to 3, number 1 in FIG. 1 indicates as a whole a snow tiller configured to prepare ski slopes and able to be drawn in a travelling direction D by a snow groomer vehicle (not shown in the drawings).

Snow tiller 1 is used to till a surface layer of the snow covering, and comprises a frame F, of which FIG. 1 shows a supporting bar 2 extending parallel to an axis A1 and crosswise to travelling direction D; two supporting structures 3 and 4 connected to supporting bar 2 by respective articulated couplings 5 enabling movement in a direction perpendicular to axis A1; and two shafts 6 and 7 supported by respective supporting structures 3 and 4. Shaft 6 extends along axis A1, and is coupled to supporting structure 3 to rotate about axis A1; while shaft 7 extends along an axis A2, and is coupled to supporting structure 4 to rotate about axis A2. In FIG. 1, axes A1 and A2 are coincident. In actual use, axes A1 and A2 may not be coincident, depending on the contour of the snow surface tiller 1 is working on. Tiller 1 also comprises a finish mat 8, which is normally flexible, is connected to supporting structures 3 and 4, extends behind shafts 6 and 7, and is drawn over the tilled snow surface.

Each supporting structure 3, 4 comprises two bars 9, 10 parallel to respective axis A1, A2; and articulated couplings 5 fixed to one bar 9, 10 to connect it to supporting bar 2 of frame F.

Supporting structure 3 comprises a casing 11. More specifically, casing 11 is in the form of an arc-shaped plate fixed crosswise to the two bars 9. Supporting structure 3 also comprises two supporting plates: an outer supporting plate 13 and inner supporting plate 14, which are fixed to the ends of the two bars 9.

Likewise, supporting structure 4 comprises a casing 12. More specifically, casing 12 is in the form of an arc-shaped plate fixed crosswise to the two bars 10. Supporting structure 4 also comprises two supporting plates: an inner supporting plate 15 and outer supporting plate 16, which are fixed to the ends of the two bars 10.

Shafts 6 and 7 are fixed to respective supporting plates 13, 14 and 15, 16 by bearings (not shown in the drawings).

Tiller 1 comprises a joint 17 configured to connect shafts 6 and 7; and articulated couplings 18 fitted to and between, to connect, inner supporting plates 14 and 15.

Supporting structures 3 and 4 are thus connected by articulated couplings 18, which enable relative movements of supporting structures 3 and 4 about a hinge axis A3 parallel to travelling direction D.

Joint 17 is configured to enable relative movements between shafts 6 and 7. Joint 17 is a constant-velocity universal joint. More specifically, joint 17 enables movement between shafts 6 and 7 in a direction parallel to travelling direction D. And joint 17 is located between the two inner supporting plates 14 and 15.

Tiller 1 comprises a number or quantity of tools 19 fitted to shafts 6 and 7. Each tool 19 extends crosswise to axis A1 or A2. More specifically, tools 19 are defined by teeth 32 fixed to one of the two shafts 6 and 7. Teeth 32 are configured to sink into and break up the snow surface.

With reference to FIG. 1, shafts 6 and 7 comprise respective hollow cylinders 20 and 21. Shaft 6 comprises two end flanges 22, 23 connected to opposite ends of hollow cylinder 20; two flanges 24, 25 integral with end flanges 22, 23 respectively; and seats 26 equally spaced along hollow cylinder 20 to house respective tools 19. Flanges 24 and 25 are fitted respectively to supporting plates 13 and 14 of supporting structure 3 by bearings (not shown in the drawings).

Likewise, shaft 7 comprises two end flanges 27, 28 connected to opposite ends of hollow cylinder 21; two flanges 29, 30 integral with end flanges 27, 28 respectively; and seats 26 equally spaced along hollow cylinder 21 to house respective tools 19. Flanges 29 and 30 are fitted respectively to supporting plates 15 and 16 of supporting structure 4 by bearings (not shown in the drawings).

Flanges 25 and 29 are also connected to joint 17. Flanges 25 and 29 each extend partly between supporting structures 3 and 4. More specifically, flanges 25 and 29 each extend partly between supporting plates 14 and 15.

Tiller 1 comprises four tools 19*a* on and on opposite sides of joint 17. The four tools 19*a* are located between supporting structures 3 and 4, and more specifically between supporting plates 14 and 15.

Tools 19*a* are defined by the appendixes of two blades 31 in the form of a rhomboid truncated at its acute angles. Blades 31 each have a hollow portion to permit assembly of joint 17, and are fixed to respective flanges 25 and 29 by bolts 40. In other words, each blade 31 is fixed directly to respective flange 25, 29 by bolts 40. More specifically, each blade 31 is fixed along a face of respective flange 25, 29. Each blade 31 forms two tools 19*a* at 180° to each other. And the two blades 31 are positioned at a 90° angle to each other.

In the example shown, shafts 6 and 7 are powered by respective electric motors (not shown in the drawings). In which case, joint 17 serves to synchronize the rotation speed of shafts 6 and 7.

In an alternative embodiment, shafts 6 and 7 are powered by one electric motor connected directly to shaft 6 or 7. In which case, in addition to synchronizing the rotation speed of the two shafts, joint 17 also transfers rotation from the shaft powered directly by the electric motor to the other shaft.

Number 101 in FIG. 3 indicates another embodiment of the tiller. All the parts of tiller 101 in common with tiller 1 are indicated using the same reference numbers. In this embodiment, joint 17 is omitted. So, the speed of shafts 6 and 7 is synchronized by a control unit controlling the motors (not shown) of shafts 6 and 7. Moreover, as opposed to blades 31 defining tools 19*a*, tiller 101 comprises blades 131 defining tools 119. Tools 119 are connected to respective shafts 6 and 7 and located between supporting structures 3 and 4. In certain embodiments, tools 119 are four in number: two connected to shaft 6, and two to shaft 7. The two blades 131 are fixed respectively to flanges 29 and 25. In other words, each blade 131 is fixed directly to a respective flange 25, 29. More specifically, each blade 131 is fixed along a face of respective flange 25, 29.

By virtue of tools 19*a* or 119, snow is groomed substantially evenly over the whole longitudinal extension of tiller 1.

By virtue of the present disclosure, tools 19 and 19*a* or 119 are more or less equally spaced along axes A1 and A2.

In an embodiment not shown, there are more than two shafts, more than two supporting structures, and more than two hinge axes.

Clearly, the present disclosure also covers embodiments not described in the above detailed description, as well as equivalent embodiments, which nevertheless fall within the protective scope of the attached Claims. That is, various changes and modifications to the presently disclosed embodiments will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A snow tiller configured to be drawn in a travelling direction along a ski slope to prepare the ski slope, the snow tiller comprising:

a plurality of supporting structures, wherein two of the supporting structures are coupled to each other by at least one articulated coupling configured to enable relative movement between the two supporting structures;

a plurality of shafts, wherein two of the shafts are respectively housed in and supported by the two supporting structures, the two shafts configured to be rotated about respective rotation axes crosswise to the travelling direction, wherein each shaft includes a flange extending partly between the two supporting structures;

a plurality of tools fitted to the two shafts; and a blade fixed directly along a face of one of the two flanges of one of the two shafts, said blade defining two further tools fixed to and extending in opposite directions from one of the two flanges of one of the two shafts, said two further tools each being located between the two supporting structures.

2. The snow tiller of claim 1, wherein each supporting structure respectively includes a bar and a casing fixed to and supported by the respective bar.

3. The snow tiller of claim 2, which includes a supporting bar coupled to the supporting structures by a further articulated coupling configured to support the supporting structures and permit relative movement between the supporting structures and the supporting bar.

4. The snow tiller of claim 3, wherein the further articulated coupling is configured to permit relative movement between the supporting structures in a direction perpendicular to the travelling direction.

5. The snow tiller of claim 1, which includes a joint connected to the two shafts and configured to permit relative angular movement between the two shafts.

6. The snow tiller of claim 5, wherein the further tools are each mounted on the joint.

7. The snow tiller of claim 6, wherein the further tools are each mounted at one end of the joint.

8. The snow tiller of claim 1, wherein the two supporting structures are coupled to each other about at least one hinge axis.

9. The snow tiller of claim 1, wherein the blade has a hollow portion to permit assembly of a joint.

10. The snow tiller of claim 1, which includes a further blade defining another two further tools, wherein the blade and the further blade are positioned at an angle of 90° to each other.

11. A snow tiller configured to be drawn in a travelling direction along a ski slope to prepare the ski slope, the snow tiller comprising:

two supporting structures coupled to each other by at least one articulated coupling configured to enable relative movement between the two supporting structures;

two shafts respectively housed in and supported by the two supporting structures, the two shafts configured to be rotated about respective rotation axes crosswise to the travelling direction, wherein each shaft includes a flange extending partly between the two supporting structures;

a joint connected to the two shafts and configured to permit relative angular movement between the two shafts;

a plurality of tools fitted to the two shafts;

a first blade fixed directly along a face of a first one of the two flanges of a first one of the two shafts, said first blade defining two first further tools positioned 180° apart, the first blade having a hollow portion to permit assembly of the joint, the first blade being fixed to the first one of the two flanges of the first one of the two shafts, said two first further tools each being located between the two supporting structures; and a second blade fixed directly along a face of a second one of the two flanges of a second one of the two shafts, said second blade defining two second further tools positioned 180° apart, the second blade having a hollow portion to permit assembly of the joint, the second blade being fixed to the second one of the two flanges of the second one of the two shafts, said two second further tools each being located between the two supporting structures, wherein the first blade and the second blade are positioned at an angle of 90° to each other.

12. The snow tiller of claim 11, wherein each supporting structure respectively includes a bar and a casing fixed to and supported by the respective bar.

13. The snow tiller of claim 11, which includes a supporting bar coupled to the supporting structures by a further articulated coupling configured to support the supporting structures and permit relative movement between the supporting structures and the supporting bar.

14. The snow tiller of claim 13, wherein the further articulated coupling is configured to permit relative movement between the supporting structures in a direction perpendicular to the travelling direction.

15. The snow tiller of claim 11, wherein at least one of the two first further tools and the two second further tools is mounted on the joint.

16. The snow tiller of claim 15, wherein at least one of the two first further tools and the two second further tools is mounted at one end of the joint.

17. The snow tiller of claim 11, wherein the two supporting structures are coupled to each other about at least one hinge axis.

* * * * *